United States Patent [19]

Olson

[11] Patent Number: 4,757,735

[45] Date of Patent: Jul. 19, 1988

[54] APPARATUS FOR SEVERING A WORK OBJECT AND THE LIKE

[76] Inventor: Bruce R. Olson, 458 S. Clovis Ave., #105, Fresno, Calif. 93727

[21] Appl. No.: 13,032

[22] Filed: Feb. 10, 1987

Related U.S. Application Data

[63] Continuation of Ser. No. 816,365, Jan. 6, 1986, abandoned.

[51] Int. Cl.[4] ..... B27B 17/02

[52] U.S. Cl. ..... 83/797; 83/527; 83/564; 83/574; 83/809

[58] Field of Search ..... 83/796, 810, 574, 564, 83/609, 797, 798, 809, 527, 529, 769, 768

[56] References Cited

U.S. PATENT DOCUMENTS

| | | | |
|---|---|---|---|
| 2,851,067 | 9/1958 | Greenslate . | |
| 3,053,290 | 9/1962 | Fitzerald | 83/798 X |
| 3,965,788 | 6/1976 | Granberg | 83/745 |
| 4,123,957 | 11/1978 | Niemela et al. | 83/796 |
| 4,214,498 | 7/1980 | Zukas et al. | 83/574 X |
| 4,283,980 | 8/1981 | Jackson | 83/798 |
| 4,350,067 | 9/1982 | Picard | 83/796 |

FOREIGN PATENT DOCUMENTS 740065 10/1943 Fed. Rep. of Germany .

*Primary Examiner*—E. R. Kazenske
*Assistant Examiner*—Hien H. Phan
*Attorney, Agent, or Firm*—Worrel & Worrel

[57] ABSTRACT

An apparatus for severing a work object and the like. The apparatus has a base member which slidably mounts a pivot assembly and a yoke which are adapted to engage a distal end of a chain saw, the base member further has an attachment member mounting an elastic cord which permits the chain saw to be moved along a path of movement from a ready position to a severing position, and an adjustable shelf is provided to limit the motion of the chain saw in the severing position to achieve a cut of a preselected depth.

8 Claims, 3 Drawing Sheets

APPARATUS FOR SEVERING A WORK OBJECT AND THE LIKE

This application is a continuation of application Ser. No. 816,365, filed on Jan. 6, 1986, now abandoned.

BACKGROUND OF THE INVENTION

1. Field of the Invention

The present invention relates to an apparatus for severing work objects and the like and more particularly to such an apparatus which rotatably mounts a conventionally configured chain saw that is operable to sever a work object into predetermined lengths. The apparatus as herein shown and described has particular utility when used to cut voluminous quantities of firewood at reasonable labor costs and which further provides improved directional stability and handling characteristics to the chain saw which is moved in an arcuate path of travel into severing relationship with a work station.

2. Description of the Prior Art

Homeowners have long recognized that the cost of heating their homes can be significantly reduced if they burn wood from time to time in their stoves. With the advent of the Arab oil embargo some ten years ago, large numbers of Americans rediscovered the wood burning stove and the fireplace insert and as a consequence began using increasing amounts of wood for the purpose of heating their homes.

As should be appreciated, the cutting of firewood into preselected lengths for use in stoves and fireplaces, etc. is quite an arduous task. Frequently, the firewood is purchased in fixed lengths, that is, four, eight or twelve foot lengths which are then delivered to the owner's property or location at which the pieces are to be cut. The homeowner thereafter cuts the firewood to length using a conventional chain saw.

A multiplicity of problems and tasks confront an individual who is attempting to cut up any significant volume of firewood. Firstly, it should be understood that commercially available chain saws, and more particularly, the chain saws that have internal combustion engines, can frequently induce user fatigue. Moreover, the repeated acts of stooping and bending to reposition a selective log for cutting with the chain saw, and the moving about a pile of firewood during the cutting process presents numerous safety problems inasmuch as it is quite easy for an individual to stumble and fall in such an environment, with potentially lethal consequences. Second, it is quite difficult in this environment to determine precisely the size of the piece of firewood being cut; and to avoid contact of the rapid moving cutting chain with the surface of the earth as a cut is being completed, it being understood that contact with the earth even for an instant, frequently necessitates that cutting operations temporarily stop while the cutting chain is resharpened, readjusted or otherwise attended to.

The prior art is replete with numerous examples of assorted chain saw support apparatus which have been detachably secured or otherwise mounted on variously designed chain saws for the purpose of aiding an individual in safely moving the chain saw in a predetermined path of travel into severing engagement with pieces of wood, or alternatively moving the wood into severing relationship with a stationary chain saw. As a general matter, most of the prior art devices utilize a chain saw which is mounted on or otherwise detachably affixed to a work surface for the purpose of aiding an individual in moving the chain saw into engagement with the pieces of wood in a preselected attitude which permits the wood to be cut in any desired length throughout a reasonable range.

While it is well understood that the utilization of these prior art chain saw mounting appratuses somewhat improves the cutting performance of a chain saw so mounted, the apparatuses, however, suffer from a multiplicity of drawbacks which have detracted from their usefulness. For example, nearly all of the prior art chain saw mounting apparatuses, in one form or another, possess a subassembly which detachably mounts the chain saw to a work surface. While these apparatuses operate with a degree of success, they have a common shortcoming in that they frequently can only process wood of selected diameters or alternatively the mounting subassembly limits the depth of the cut that the chain saw can impart. Moreover, the prior art chain saw support apparatuses have usually required, as a general matter, that the chain guide bar of the chain saw be altered in some fashion to permit it to be mounted on the apparatus.

Still another significant problem with the prior art chain saw support apparatuses results from characteristics inherent in their design inasmuch as the prior art devices have frequently been of such a design that they are inconvenient to disassemble or move, and are not easily utilized in rough or rugged terrain.

Therefore it has long been known that it would be desirable to have an apparatus for severing a work object and the like and which is particularly well suited to pivotally mounting a conventional chain saw. The apparatus is operable to increase the cutting performance and directional stability of the chain saw so mounted, as it is urged into severing engagement with the work object to be cut.

SUMMARY OF THE INVENTION

Therefore, it is an object of the present invention to provide an improved apparatus for severing work objects or the like.

Another object is to provide such an apparatus which detachably mounts for pivotal movement a conventional chain saw or the like.

Another object is to provide such an apparatus which is particularly well suited to improving the cutting performance of a conventionally designed chain saw.

Another object is to provide such an apparatus which improves the directional stability of a chain saw which is urged into severing engagement with a work object.

Another object is to provide an apparatus which has a slidably adjustable pivot assembly and yoke which are mounted on a base, the pivot assembly and yoke being adapted to capture the distal end of the chain saw for movement in a predetermined path of travel.

Another object is to provide such an apparatus which improves the cutting performance of a chain saw, while simultaneously holding the work object to be cut in a secure predetermined attitude at a selected work station.

Another object is to provide such an apparatus which is operable to obtain the individual benefits to be derived from the prior art chain saw support apparatus while avoiding the numerous detriments individually associated therewith.

Another object is to provide such an apparatus which can be easily transported and can be effectively employed at remote sites, or on uneven terrain, or in spite of obstacle impediments.

Another object is to provide such an apparatus which is easy and safe to operate, is dependable and efficient, and which further reduces to a minimum the possibility of malfunction.

Another object is to provide such an apparatus which is characterized by simplicity of design, ease of employment and which can be sold at a nominal price.

Another object is to provide such an apparatus which can be adapted pivotally to mount assorted sizes or chain saws for the purpose of increasing the speed with which a given volume of a work object can be processed.

Further objects and advantages are to provide improved elements and arrangements thereof in an apparatus for the purposes described which is dependable, economical, durable and fully effective in accomplishing its intended purposes.

These and other objects and advantages are achieved in apparatus for severing a work object and the like of the present invention wherein in the preferred embodiment a planar base member slidably mounts an adjustable pivot assembly and yoke which are adapted rotatably to mount a chain saw of acceptable configuration, the apparatus defining a path of travel for the chain saw which imparts improved cutting performance to the chain saw so mounted.

DESCRIPTION OF THE PREFERRED EMBODIMENT

Figure 1:
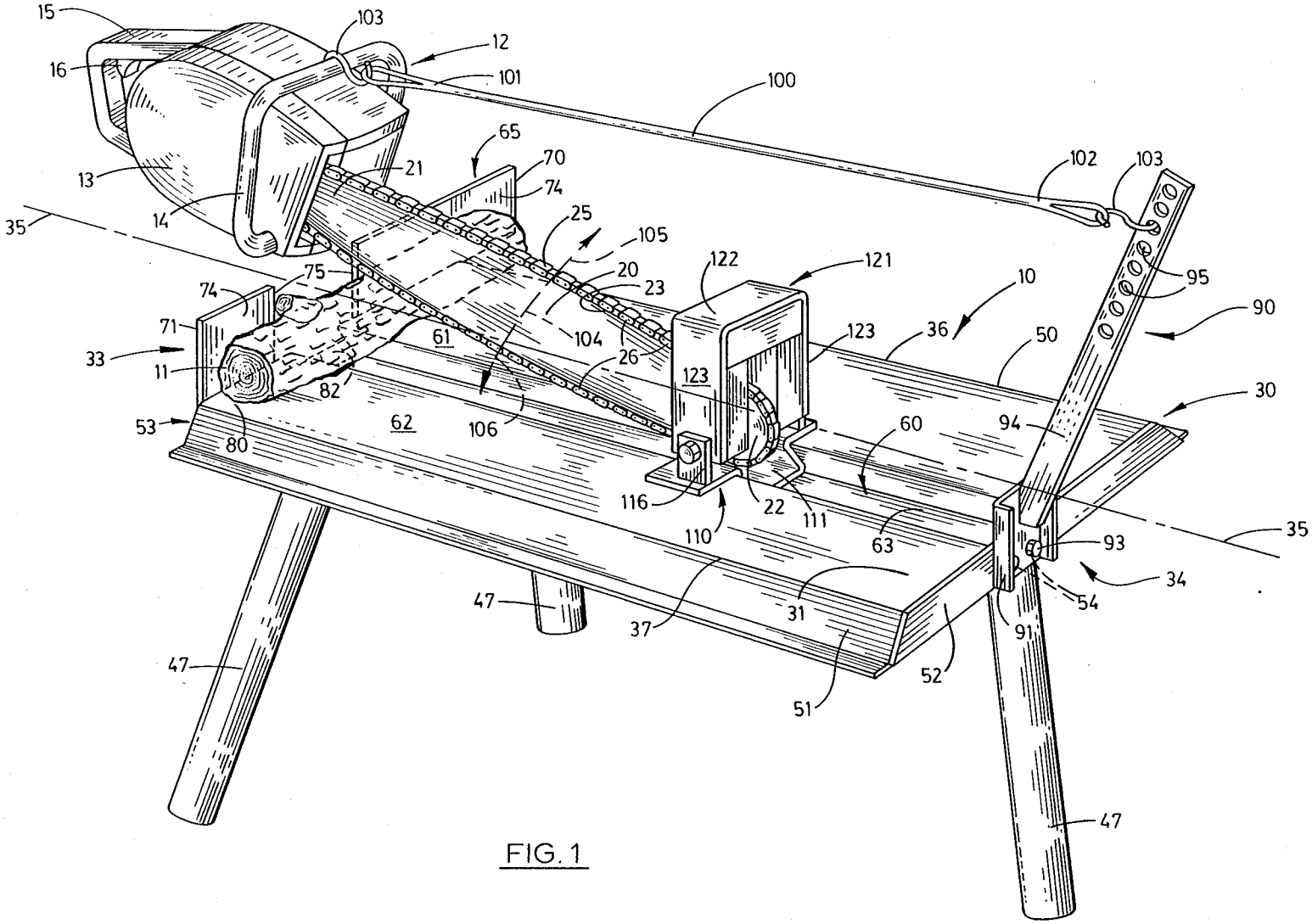
FIG. 1 is a perspective view of the apparatus for severing a work object and the like embodying the principles of the present invention shown in a typical operative configuration, mounting a conventional chain saw.

Referring more particularly to the drawings, the apparatus for severing a work object and the like of the present invention is generally indicated by the numeral 10 in FIG. 1.

The apparatus 10, as shown and described, is illustrated in a typical operative environment wherein it is depicted as being employed to sever a work object which is illustrated as a log or piece of wood 11. The apparatus detachably mounts for pivotal movement a conventionally designed chain saw 12 which has an internal combustion engine 13. The engine 13 mounts a rigid carrying handle 14, and a control handle 15 that houses a throttle control 16. Detachably secured to the engine is an elongated chain guide bar 20 that has a proximal end 21 which is screw-threadably affixed on the engine, not shown, and a distal end 22. The guide bar 20 has a peripheral edge 23 which has formed therein a chain track 24 which is conformably adapted to receive an elongated continous cutting chain 25 of well known form. The cutting chain is of conventional design having a multiplicity of links 26 which mount spaced cutting members, not shown. The multiplicity of links mount spaced guide teeth 27 which slidably travel in the chain track. As should be appreciated the chain saw is operable rotatably to urge the cutting chain to move in a circular or circuitous fashion about the peripheral edge of the guide bar.

Figure 2:
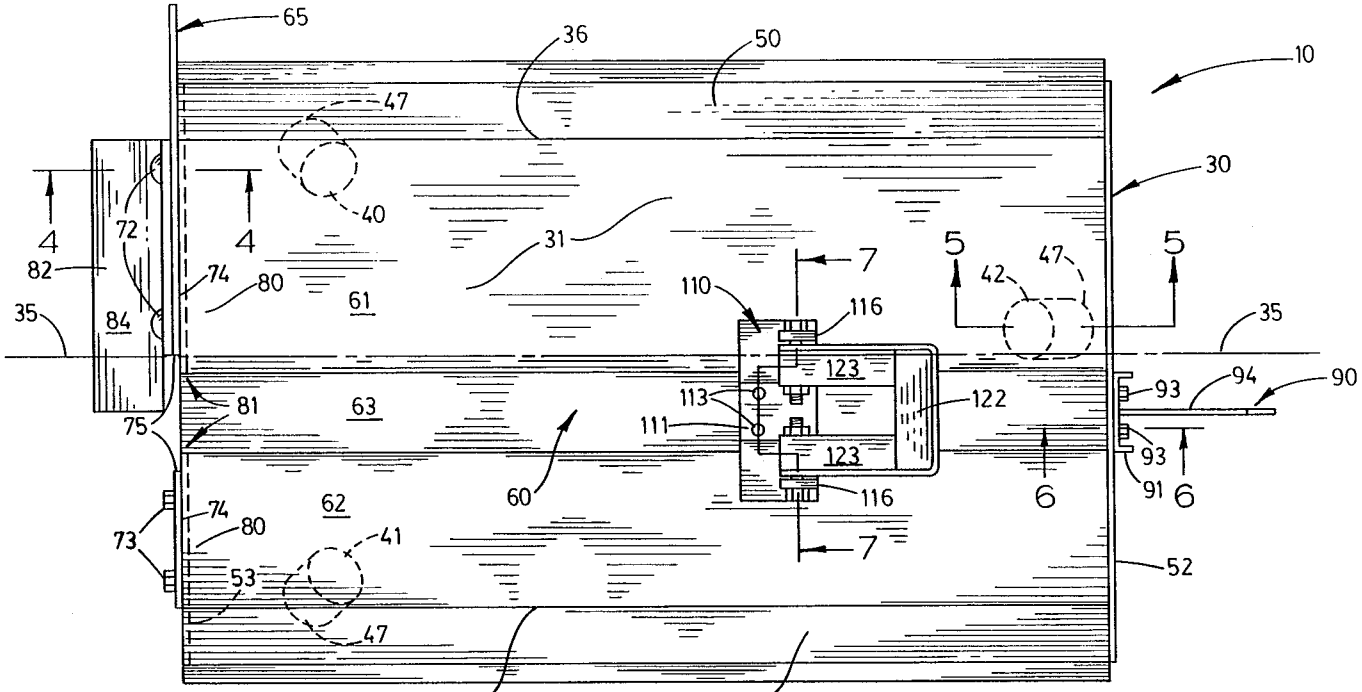
FIG. 2 is a top plan view of the apparatus of the subject invention shown in a typical operational configuration with the chain saw removed for illustrative convenience to show the underlying structure.

As best seen by reference to FIGS. 1 and 2, the apparatus 10 has a substantially planar base member 30 that has a top surface 31, an opposed bottom surface 32, a proximal or operator's end 33, and a distal end 34. The base member 30 furthermore has a longitudinal axis indicated by the line labeled 35, a left side 36, and a right side 37. Mounted on the bottom surface 32 of the base member by welding or the like are three leg sockets 40, 41, and 42, respectively. The individual leg sockets are positioned to form a tripod. As best appreciated by a study of FIGS. 1 and 2, the leg sockets are widely separated, that is, leg sockets 40 and 41 are positioned in close proximity to the operator end 33, and adjacent to the left and right sides 36 and 37 of the base member, and leg socket 42 is mounted in close proximity to the longitudinal axis 35 at the distal end 34 of the base member. The individual leg sockets are affixed in an outwardly disposed angulated attitude and thus allow the base member to be quite stable even when used in rough or uneven terrain. Each leg socket has a rigid annular wall 43 that defines a cavity 44. Formed into the annular wall 43 is a threaded orifice 45 which is adapted to receive a bolt or thumb screw 46. The cavity 44 receives an appropriately dimensioned leg 47 which is held internally of the cavity by the bolt or thumb screw.

Figure 3:
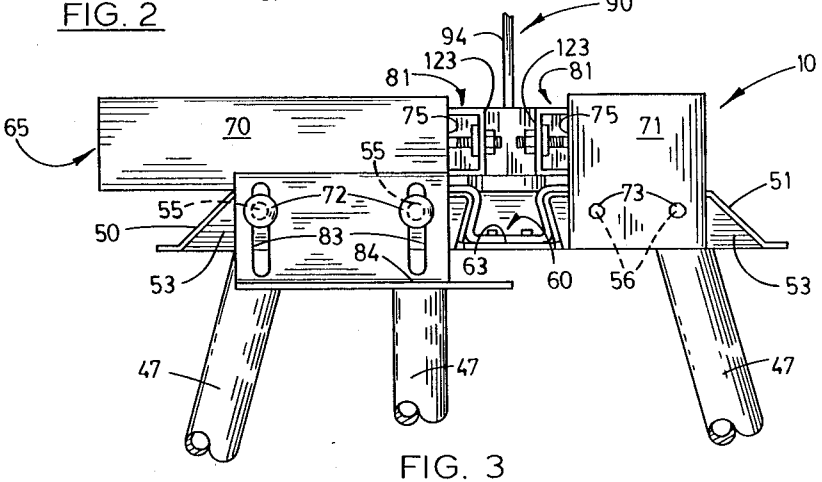
FIG. 3 is a front elevational view of the apparatus of the subject invention showing an adjustable shelf at an operator's position.
Figure 6:
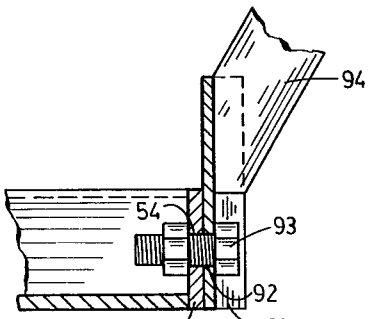
FIG. 6 is a somewhat enlarged, fragmentary, vertical section taken on line 6—6 of FIG. 2 and showing an attachment arm thereof.
Figure 4:
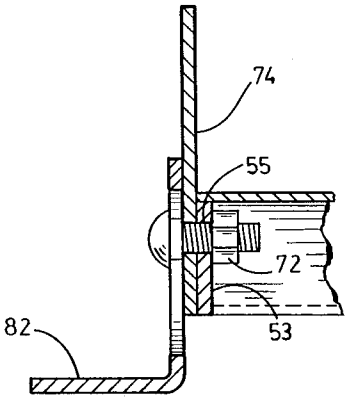
FIG. 4 is a somewhat enlarged, fragmentary, vertical section taken along line 4—4 of FIG. 2 showing the adjustable shelf at the operator's position.
Figure 5:
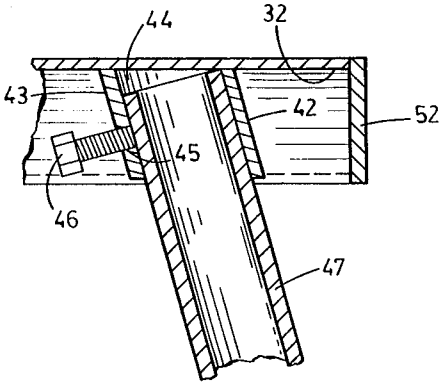
FIG. 5 is a somewhat enlarged, fragmentary, vertical section taken on line 5—5 of FIG. 2 and showing a leg fixture and a detachable leg mounted therein.

Mounted to the left and right sides 36 and 37 of the base member 30 are side walls 50 and 51, of angulated configuration. The side walls 50 and 51 are adapted to aide in the movement of the logs 11 onto the top surface 31 of the base member, and to provide a convenient location which permits the base member to be clamped to a stationary object, not shown, if the base member is utilized without the legs. Mounted in a substantially normal attitude with respect to the bottom surface 32, is a distal end wall 52 and a proximal end wall 53. As should be appreciated, the distal and proximal end walls 52 and 53, respectively, are welded to the base member 30 and to side walls 50 and 51. A pair of orifices 54 are formed substantially centrally of the distal end wall and in an attitude closely adjacent to the longitudinal axis 35 of the base member and a pair of mounting holes 55 and 56, respectively, are formed in the proximal end wall. This is bests illustrated by reference to FIGS. 3 and 4.

A recessed channel or dovetailed slot 60 is formed into or otherwise mounted to the base member 30 in an attitude that is in parallel spaced relationship to the longitudinal axis 35. As should be appreciated by a study of FIG. 2, the channel 60 divides the top or supporting surface 31 into a pair of unequal left and right sectors 61 and 62, respectively, the left sector 61 being the widest and the right sector 62 the narrowest. As should be appreciated, the wood or log 11 will be supported on the top surface 31 of the base member and will be fed into a position where it lies across the channel. The chain saw 12 will thereafter cut the log, in a manner which will hereinafter be discussed in greater detail. When the cutting process is completed, the severed piece of log will be rolled off of, or removed from, the area of the right sector 62. The channel has a substantially horizontal bottom member 63 which mounts a pair of inwardly convergent side walls 64. The channel, therefore, takes on the shape of the base of a truncated right triangle.

Mounted at the operator's end 33 of the base member 30 is a work stop generally indicated by the numeral 65. The work stop has a first wall 70, and a second wall 71. As best understood by a study of FIG. 3, a pair of bolts and nuts 73 and 74, respectively, screw-threadably affix the first and second wall to the proximal end wall 53. As will be appreciated, the pair of bolts and nuts 73 and 74 are slidably received through the pair of mounting holes 55 and 56, respectively. The first and second walls further have an inside surface 74, and a vertical inside edge 75. The inside surface 74 defines a work station 80 which restrains and confines the log 11 which is subsequently cut by the chain saw 12. The vertical inside edge 75 of the first and second walls further defines a cutting port 81. Mounted in close proximity to the cutting port is an adjustable shelf 82 which is herein illustrated as an angle iron bracket. As best seen by reference to FIG. 3, the adjustable shelf has formed therein a pair of elongated slots 83 which are positioned to be in registry with the pair of bolts and nuts 72 which are received through the proximal end wall 53. The adjustable shelf has an inside portion 84 which limits the movement of the chain saw as it is moved into and out of the channel 60.

The apparatus 10 mounts an obliquely disposed attachment arm generally indicated by the numeral 90. The attachment arm has a mounting plate 91 which has formed therein a pair of orifices 92 which are adapted slidably to receive a pair of appropriately dimensioned bolts and nuts 93. An elongated arm 94 is affixed by welding or the like at an oblique angle to the mounting plate. The elongated arm has formed therein a multiplicity of bores or holes 95 which permit an elastic cord 100 to be attached thereto. As best understood by reference to FIG. 1, the elastic cord has a first end 101 and a second end 102. Affixed to the first and second end, respectively, is a rigid hook 103. The elastic cord is adapted releasably to affix and selectively impart pivotal motion to the chain saw 12 in an arcuate path of movement generally indicated by the line labeled 104. The path of travel defined by the elastic cord extends from the ready position 105 wherein the chain saw is releasably affixed in spaced relation from the work station 80, and the severing position 106 wherein the chain saw is brought into cutting relationship with the log 11 which is placed in the work station.

An adjustable pivot assembly generally indicated by the numeral 110 is slidably captured in mating receipt internally of the channel 60. As best seen by reference to FIG. 7, the pivot assembly is composed of an appropriately dimensioned base plate 111 which can be slidably received internally of the channel. The base plate has formed therein a pair of threaded orifices 112 which are adapted to receive a locking member which is herein illustrated as a pair of Allen screws or bolts 113. Mounted to the base plate by a suitable weld or the like is a pair of walls 114, each of which is conformably dimensioned slidably to mate with the side walls 64 which define the channel 60. The pair of walls 114 each have a proximal end 115 which is welded to the base plate 111 and a substantially vertically disposed distal end 116, which has formed therein a bolt receiving station 120. As should be appreciated, the bolt receiving stations are aligned and in substantial registry one with the other. The pivot assembly 110 can be selectively locked into a predetermined location internally of the channel 60 by tightening the Allen screws 113 which are screw-threadably received internally of the threaded orifices 112. As the Allen screws are tightened, the pivot assembly is urged upwardly into a locking relationship with the side walls 64 which define the channel 60. Thus, the pivot assembly can be selectively secured in a multiplicity of locations in the channel for the purpose of accomodating variously dimensioned chain saws which can be rotatably mounted on the apparatus 10, as will subsequently be described in greater detail.

Figure 7:
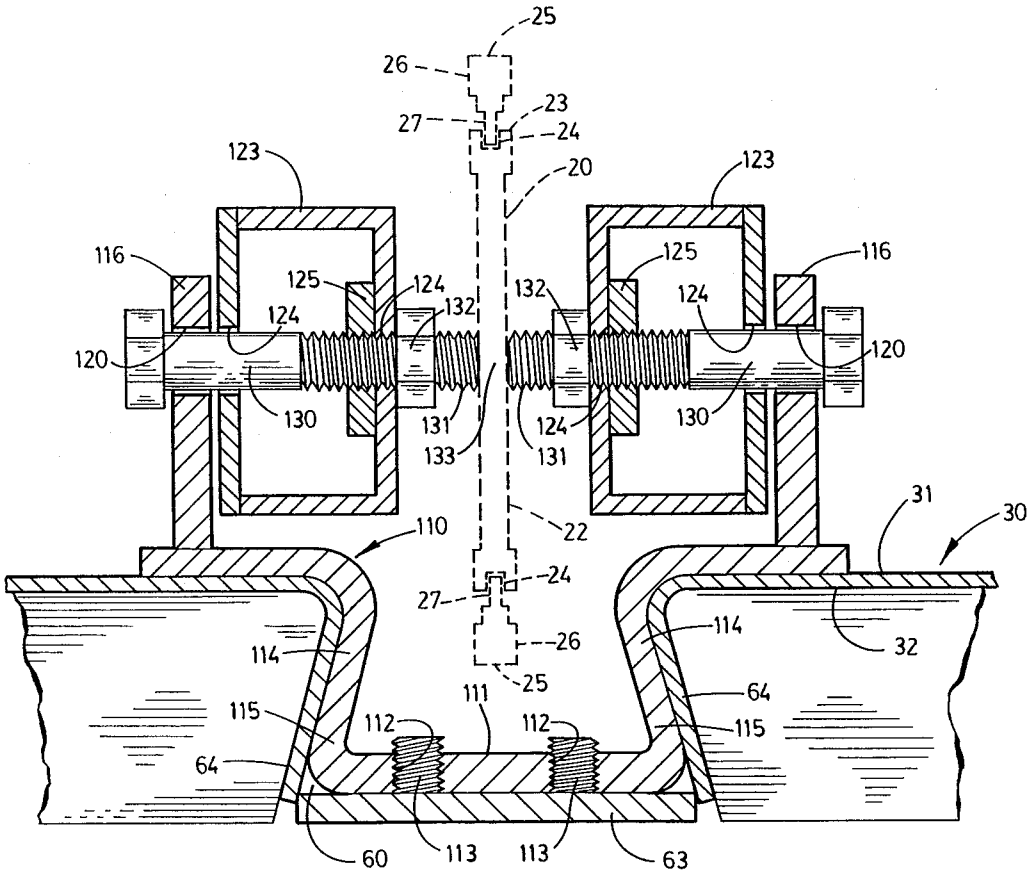
FIG. 7 is a somewhat further enlarged, fragmentary, vertical section of the apparatus of the subject invention taken on line 7—7 of FIG. 2 and showing, in phantom lines, a chain saw guide bar mounted for rotational movement in a receiving station.

A substantially U-shaped yoke, having a hollow, substantially rectangularly shaped cross section, which is generally indicated by the numeral 121, is screw-threadably secured to the pivot assembly 110. As best understood by reference to FIGS. 2 and 7, the yoke 121 has a base member 122 which mounts a pair of dependent legs 123. As should be appreciated, the yoke is fabricated out of commercially available channel beam of sufficient strength to permit the apparatus 10 to affix securely a chain saw 12. Each of the dependent legs has formed therein at precisely the same attitude, a bolt-receiving station 124. Welded internally of each of the dependent legs is a threaded substantially annular reinforcement member 125 which provides added strength to the bolt-receiving station 124 which is formed in each of the dependent legs. A pair of bolts 130 are individually mounted into screw-threadable mating receipt with the bolt-receiving stations 124. As best seen in FIG. 7, the pair of bolts 130 each have a threaded distal end 131 which is adapted to receive a locking or jam nut 132. The distal ends of the pair of bolts 130 define a receiving station 133 which is adapted rotatably to capture the distal end 22 of the chain saw guide bar 10 in secure mating relationship.

OPERATION

The operation of the described embodiment of the present invention is believed to be readily apparent and is briefly summarized at this point.

The apparatus 10 for severing a work object and the like of the present invention is best understood by reference to FIG. 1. As shown therein, the chain saw 12 having a chain guide bar 20 is rotatably mounted in secure mating relationship internally of the receiving station 133 which is defined by the distal ends 131 of the pair of bolts 130. The pair of bolts 130 are tightened against the chain guide bar by the action of the locking nuts 132 which are screw-threadably tightened against the individual depending legs 123 of the yoke 121. In this fashion, the pair of bolts oppose each other and thus securely capture the distal end 22 of the chain guide bar in the receiving station, but simultaneously permit the chain saw 12 to be freely moved in the path of movement 104 defined therebetween the ready position 105 and the severing position 106.

To make the apparatus 10 operational, the pivot assembly 110 is first positioned in an appropriate attitude internally of the channel 60, and is thereafter securely affixed at that selected location by tightening the Allen screws 113 which are screw-threadably mounted on the base plate 111. As should be appreciated, the pivot assembly will be mounted at a predetermined location which will permit the internal combustion engine 13 of the chain saw 12 to move into contact with the inside portion 84 of the adjustable shelf 82 when the chain saw is urged into the severing position 106. In this fashion, the adjustable shelf is operable to limit the motion of the chain saw when it is moved into the severing position to achieve the two-fold effect of cutting the log 22 to a predetermined depth and ensuring that the cutting chain 25 does not come into contact with the base member 30.

Following the procedure of locking the pivot assembly 110 in an appropriate location internally of the channel 60, the distal end 22 of the chain guide bar 20 is rotatably mounted internally of the receiving station 133 in the manner which was earlier discussed. The last step of making the apparatus 10 operational requires the interconnection of the elastic cord 100 between the carrying handle 14 of the chain saw 12, and the attachment arm 90. The first end 101 of the elastic cord is connected to the carrying handle and thereafter stretched a sufficient distance to permit the rigid hook 103 mounted to the second end 102 to engage a preselected hole 95 which has been formed into the elongated arm 94. As should be understood, the hole 95, which is selected, will permit the chain saw 12, when it is moved into the severing position 106, to remain in that position without automatically returning to the ready position 105 when released by the operator, not shown, but will simultaneously releasably affix the chain saw in the ready position when it is moved back to that position. Of course, it should be appreciated that more than one elastic cord may be required in those instances where a heavy chain saw is employed.

In operation, therefore, an operator standing at the operator's end 33 places a log 11 to be cut on the base member 30 and moves it into engagement with the work station 80. The desired length of the piece of log would thereafter be determined by measuring the distance from a location substantially centrally of the channel 60 to the end of the log. The operator then adjusts the log as appropriate, and then grasps the chain saw at the control handle. By employing the throttle 16, the operator accelerates the cutting chain 25 to a desired cutting speed, and would rotatably move the chain saw from the ready position 105 to the severing position 106, thus urging the cutting chain into severing relationship with the log. After the desired cut has been attained, the operator thereafter releases the control handle and removes the severed piece of log from the right sector 62. The operator, following these steps, raises the chain saw 12 to the ready position and repositions the log for a further cut. It will be understood that the apparatus 10 as herein shown and described makes only perpendicular cuts with respect to the log, however, the apparatus can be adapted to make a mitered cut by utilizing a movable work stop assembly which is familiar to those skilled in the art.

Therefore, the apparatus for severing a work object and the like of the present invention is particularly well suited to making cuts of any desired depth, is adapted to improve the directional stability of a chain saw which is mounted on such an apparatus, can be employed in a wide variety of operational environments, is compact, easy to assemble and maintain, and reduces to a minimum the problems and shortcomings of other types of chain saw support apparatus designed for essentially the same purpose to which reference has been made.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for severing a work object and the like comprising means for supporting a work object to be severed in a predetermined work station, the support member having a substantially planar base member which has formed therein a recessed channel with a cross section having the shape of a base of a truncated right triangle;

means for severing a work object pivotally mounted by a pivot assembly on the base member, the means for severing the work object movable along a path of travel between a ready position wherein the severing means is releasably affixed in spaced relation to the work station and a severing position wherein said severing means is movable into cutting relation to the work object, and the pivot assembly mounts a U-shaped yoke which is screw-threadably mounted on the pivot assembly, said pivot assembly being dimensioned for detachably slidable mounted receipt internally of the channel, said yoke further having formed therein a pair of bolt receiving stations, each bolt receiving station being screw-threadably adapted to receive a bolt, the pair of bolt receiving stations being aligned in substantial registry with each other;

means mounted on the base for releasably affixing and selectively imparting pivotal motion to the severing means along the path of travel;

a work stop mounted on the base in a substantially normal attitude to restrain the work object being severed on the base; and means borne by the base for limiting the motion of the severing means in the severing position to achieve a cut in the work object of a predetermined depth.

2. The apparatus of claim 1 wherein the severing means is a chain saw which mounts a chain guide bar having a distal end, the distal end of the chain guide bar being rotatably secured in a predetermined attitude internally of the U-shaped yoke, and the means for selectively imparting pivotal motion to the severing means along the path of travel is an attachment arm which is affixed to the planar base member, the attachment arm mounting an elastic cord which is detachably affixed to the chain saw, said elastic cord releasably affixing the chain saw in the ready position, and adapted to permit the chain saw to be moved to the severing position.

3. The apparatus of claim 2 wherein the planar base member mounts an adjustable shelf in close proximity to the work station, said shelf being operable to limit the motion of the chain saw when it is moved into the severing position to achieve a cut in the work object of a predetermined depth.

4. An apparatus for severing a work object and the like, and wherein the means for severing a work object is a chain saw having an internal combustion engine mounting a handle and a chain guide bar, the chain saw being operable rotatably to urge a cutting chain to move in a circuitous fashion about the guide bar, the apparatus comprising a planar base member having a supporting surface, a work station, an operator's end, and a distal end, the supporting surface having formed therein a dovetailed slot which extends in a nearly normal attitude with respect to the work station to the distal end, the dovetailed slot defining a channel having a substantially horizontal bottom member and a pair of spaced inwardly convergent side walls, the planar base member further mounting a work stop which restrains the work object being severed, said work stop being mounted on the operator's end of the substantially planar base member and defining a cutting port that is positioned in substantial registry with the dovetailed slot;

an adjustable pivot assembly is slidably captured internally of the dovetailed slot, the pivot assembly has a base plate mounting a pair of inwardly convergent walls, said base plate further mounting a locking member adapted to secure the pivot assembly internally of the dovetailed slot, the inwardly convergent walls each have a distal end which has formed therein a bolt-receiving station, each bolt-receiving station being aligned and in substantial registry one with the other;

a U-shaped yoke is screw-threadably secured to the pivot assembly, the yoke has a pair of substantially rigid dependent legs each of which has formed therein a bolt-receiving station, and the yoke is joined to the pivot assembly by a pair of bolts each of which is individually screw-threadably received into the bolt-receiving stations formed in the yoke and the bolt-receiving station formed in the pivot assembly, the pair of bolts each have a distal end which define a receiving station for rotatably capturing the chain guide bar; and an attachment arm mounting an elastic cord affixed to the distal end of the planar base member, the attachment arm defining a path of movement between a ready position wherein the chain saw is detachably held in spaced relation to the work station and a severing position wherein the chain saw is held in cutting relation with the work object to be severed.

5. The apparatus of claim 4 wherein an adjustable shelf is mounted on the operator's end of the planar base member, said adjustable shelf limiting the movement of the chain saw in the severing position.

6. The apparatus of claim 5 wherein the adjustable pivot assembly is conformably dimensioned for slidable mating receipt internally of the channel and the locking member borne by the base is at least one screw, the screw engaging the bottom member of the dovetailed slot to urge the inwardly convergent walls of the pivot assembly to engage the inwardly convergent walls of the dovetailed slot in locking relation.

7. The apparatus of claim 6 wherein the chain saw guide bar has a distal end which is rotatably captured therebetween the distal ends of the pair of bolts which define the receiving station, and the path of travel of the chain saw is substantially arcuate and aligned with the dovetailed slot.

8. The apparatus of claim 7 wherein the adjustment arm has a multiplicity of orifices formed therein, said orifices operable to mount the elastic cord in a preselected attitude to engage the chain saw.

* * * * *

UNITED STATES PATENT AND TRADEMARK OFFICE

CERTIFICATE OF CORRECTION

PATENT NO. : 4,757,735

DATED : July 19, 1988

INVENTOR(S) : Bruce R. Olson

It is certified that error appears in the above-identified patent and that said Letters Patent are hereby corrected as shown below:

Column 3, line 13, delete "or" and substitute ---of---.

Column 4, line 63, delete "bests" and substitute ---best---.

Signed and Sealed this

Fifteenth Day of November, 1988

*Attest:*

DONALD J. QUIGG

*Attesting Officer*

*Commissioner of Patents and Trademarks*